US010516245B2

(12) United States Patent
Matsuo et al.

(10) Patent No.: US 10,516,245 B2
(45) Date of Patent: Dec. 24, 2019

(54) TERMINAL AND METHOD OF MANUFACTURING A TERMINAL

(71) Applicants: Furukawa Electric Co., Ltd., Tokyo (JP); Furukawa Automotive Systems Inc., Shiga (JP)

(72) Inventors: Ryosuke Matsuo, Tokyo (JP); Kengo Mitose, Tokyo (JP)

(73) Assignees: FURUKAWA ELECTRIC CO., LTD., Tokyo (JP); FURUKAWA AUTOMOTIVE SYSTEMS INC., Shiga (JP)

( * ) Notice: Subject to any disclaimer, the term of this patent is extended or adjusted under 35 U.S.C. 154(b) by 714 days.

(21) Appl. No.: 15/255,838

(22) Filed: Sep. 2, 2016

(65) Prior Publication Data

US 2016/0372882 A1 Dec. 22, 2016

Related U.S. Application Data

(63) Continuation of application No. PCT/JP2015/056565, filed on Mar. 5, 2015.

(30) Foreign Application Priority Data

Mar. 5, 2014 (JP) ..... 2014-043192

(51) Int. Cl.

| | |
|---|---|
| ***C22C 21/00*** | (2006.01) |
| ***H01R 43/16*** | (2006.01) |
| ***C22F 1/04*** | (2006.01) |
| ***H01R 13/03*** | (2006.01) |
| ***C22C 21/02*** | (2006.01) |
| ***C22C 21/08*** | (2006.01) |
| ***C22F 1/043*** | (2006.01) |
| ***C22F 1/047*** | (2006.01) |
| ***C25D 5/12*** | (2006.01) |
| ***C25D 5/44*** | (2006.01) |
| ***C25D 7/00*** | (2006.01) |
| ***C22C 21/06*** | (2006.01) |

(52) U.S. Cl.

CPC ..... *H01R 43/16* (2013.01); *C22C 21/00* (2013.01); *C22C 21/02* (2013.01); *C22C 21/06* (2013.01); *C22C 21/08* (2013.01); *C22F 1/04* (2013.01); *C22F 1/043* (2013.01); *C22F 1/047* (2013.01); *C25D 5/12* (2013.01); *C25D 5/44* (2013.01); *C25D 7/00* (2013.01); *H01R 13/03* (2013.01)

(58) Field of Classification Search

CPC ..... C22C 21/00

See application file for complete search history.

(56) References Cited

U.S. PATENT DOCUMENTS

| | | |
|---|---|---|
| 2012/0115375 A1 | 5/2012 | Kakuta |
| 2014/0235116 A1 | 8/2014 | Otsuka et al. |

FOREIGN PATENT DOCUMENTS

| | | | |
|---|---|---|---|
| CN | 102439796 | A | 5/2012 |
| EP | 2434584 | A1 | 3/2012 |
| JP | S53-122790 | A | 10/1978 |
| JP | H04-41646 | A | 2/1992 |
| JP | H04-41648 | A | 2/1992 |
| JP | H05-78889 | A | 3/1993 |
| JP | 2000-207940 | A | 7/2000 |
| JP | 2006-009140 | A | 1/2006 |
| JP | 2007-077486 | A | 3/2007 |
| JP | 4326797 | B2 | 9/2009 |
| JP | 2013-054824 | A | 3/2013 |
| JP | 2013-124389 | A | 6/2013 |
| JP | 2013-227630 | A | 11/2013 |
| WO | 2013/065583 | A1 | 5/2013 |

OTHER PUBLICATIONS

English machine translation of JP H05-078889 A of Hoshino (Year: 1991).*

Communication Under Rule 71(3) for EP Application No. 15758508.4 dated Jul. 16, 2018.

Office Action dated Mar. 27, 2018 in a corresponding Chinese Application No. 201580008779.4.

Extended European Search Report for EP Application No. 15758508.4 dated Aug. 1, 2017.

International Search Report and Written Opinion dated Jun. 2, 2015 in counterpart PCT Application No. PCT/JP2015/056565.

Office Action for JP Application No. 2016-506560 dated Aug. 20, 2018.

Sato, "Aging Heat Treatment and Precipitation Hardening of Aluminum Alloy", Japan Foundry Engineering Society Kanto Branch, Feb. 2, 2014, <http://www.jimono.com/column/daredemo/64.html>.

English Translation of International Preliminary Report on Patentability Chapter I dated Sep. 6, 2016 in counterpart PCT application PCT/JP2015/056565.

English Translation of the Written Opinion of the International Search Authority dated Jun. 2, 2015 in counterpart PCT application PCT/JP2015/056565.

Decision to Grant Patent for JP Application 2016-506560 dated Feb. 4, 2019.

Notification for Granting an Invention Patent for CN Application No. 201580008779.4 dated Nov. 1, 2018.

* cited by examiner

*Primary Examiner* — Jophy S. Koshy

(74) *Attorney, Agent, or Firm* — Thompson Coburn LLP

(57) ABSTRACT

A method of manufacturing a terminal comprising, in the following order, preparing a sheet material comprising 0.005 mass %-3.000 mass % in total of at least one element selected from Mg, Si, Cu, Zn, Mn, Ni, Cr and Zr, the balance being Al and incidental impurities, performing solution heat treatment by heating the sheet material, cold rolling the solution heat treated sheet material, forming a metal coating layer over a part of or an entirety of the cold-rolled sheet material, the metal coating layer being composed primarily of Sn, Cr, Cu, Zn, Au or Ag, or an alloy composed primarily thereof, forming a developed terminal material by punching the sheet material into a developed view geometry of a terminal, forming the developed terminal material into a terminal, and performing an aging treatment on the terminal at 150-190° C. for 60-600 minutes.

4 Claims, 10 Drawing Sheets

TERMINAL AND METHOD OF MANUFACTURING A TERMINAL

CROSS REFERENCE TO RELATED APPLICATIONS

This is a continuation application of International Patent Application No. PCT/JP2015/056565 filed Mar. 5, 2015, which claims the benefit of Japanese Patent Application No. 2014-043192, filed Mar. 5, 2014, the full contents of all of which are hereby incorporated by reference in their entirety.

BACKGROUND

Technical Field

The present disclosure mainly relates to a terminal used in automobiles and a method of manufacturing a terminal.

Background

A wire harness used in automobiles or the like is a connecting structural body in which terminals and coated wires are joined together. Currently, there are efforts towards replacement of a copper alloy with an aluminum alloy for a core wire of coated wires used in wire harnesses. However, there is a problem that corrosion between dissimilar metals is likely to occur at a contact between aluminum (aluminum alloy) constituting a core wire and copper (copper alloy) constituting a terminal. As corrosion progresses, a crack or a poor contact will occur at a connecting portion between the core wire and the terminal. In this regard, for further practical use in the future, studies are underway for obtaining a terminal with less corrosion problem.

For example, in order to eliminate corrosion, a connecting structural body exists in which a crimping portion between a copper terminal and an electric wire core is in a sealed state (Japanese Patent No. 4326797). Also, there are terminals composed of an aluminum alloy, which is the same as a material of a core wire of an electric wire (Japanese Laid-Open Patent Publication Nos. S53-122790, H4-41646, H4-41648 and 2013-54824).

However, according to Japanese Patent No. 4326797, a cap forming process is separately required to provide a sealed condition at a crimping portion between a copper terminal and a core wire, and a filler for waterproofing is disposed between the cap and the core wire. Accordingly, a higher cost is required than conventional terminals. This results in a higher cost for the terminal and the core wire in total, even if cost reduction due to the replacement of a copper alloy with an aluminum alloy for the core wire is taken into account. This is one of the reasons why changing over to an aluminum alloy core wire is not spreading.

Japanese Laid-Open Patent Publication No. S53-122790 discloses using an aluminum alloy as a terminal material, but merely discloses an example using pure aluminum, and a strength and heat resistance thereof are not applicable for a terminal having a mating spring. According to Japanese Laid-Open Patent Publication Nos. H4-41646 and H4-41648, 6000-series aluminum alloys are used as terminal materials. However, since these are materials subjected to solution heat treatment and thereafter to an aging treatment at room temperature, it cannot be denied that they are poor in strength. According to Japanese Laid-Open Patent Publication No. 2013-54824, 2000-series, 6000-series, and 7000-series Al alloys are used as terminal materials, and a terminal is manufactured by casting, hot rolling, cold rolling and various heat treatment steps. However, there is a problem that they have a high strength and a poor formability during the forming and working, and thus there is a difficulty in processing a sheet material into a terminal.

The present disclosure is related to providing a terminal having a higher strength and improved stress relaxation resistance, and showing a low contact resistance as a terminal initially and after an endurance test. Further, the present disclosure is related to providing a manufacturing method for forming a terminal having an effect described above in an improved manner.

SUMMARY

According to a first aspect of the present disclosure, a terminal comprises a metal member including a base material and a metal coating layer disposed over a part of or an entirety of the base material, the base material having a composition comprising 0.005 mass % to 3.000 mass % in total of at least one element selected from Mg, Si, Cu, Zn, Mn, Ni, Cr and Zr, the balance being Al and incidental impurities, and has greater than or equal to 500 precipitates/$\mu m^2$, the precipitate having an average particle size of 10 nm to 100 nm, and the metal coating layer being composed of Sn, Cr, Cu, Zn, Au or Ag, or an alloy composed primarily thereof.

It is preferable that the metal member further has an oxide layer disposed over a surface of the metal coating layer, and the oxide layer is composed primarily of an oxide of a major component of the metal coating layer, and has a thickness of less than or equal to 50 nm.

It is preferable that the terminal further comprises at least one undercoat layer between the base material and the metal coating layer.

It is preferable that the undercoat layer comprises one of Ni, Co, an alloy composed primarily of Ni and an alloy composed primarily of Co.

According to a second aspect of the present disclosure, a method of manufacturing a terminal, includes, in the following order: preparing a sheet material comprising greater than or equal to 0.005 mass % and less than or equal to 3.000 mass % in total of at least one element selected from Mg, Si, Cu, Zn, Mn, Ni, Cr and Zr, the balance being Al and incidental impurities; performing solution heat treatment by heating the sheet material; cold rolling the solution heat treated sheet material; forming a metal coating layer over a part of or an entirety of the cold-rolled sheet material, the metal coating layer being composed primarily of Sn, Cr, Cu, Zn, Au or Ag, or an alloy composed primarily thereof; forming a developed terminal material by punching the sheet material on which the metal coating layer is formed into a developed view geometry of a terminal; forming the developed terminal material into a terminal; and performing an aging treatment on the terminal under a condition of 150° C. to 190° C. for 60 to 600 minutes.

According to a third aspect of the present disclosure, a method of manufacturing a terminal, includes, in the following order: preparing a sheet material comprising greater than or equal to 0.005 mass % and less than or equal to 3.000 mass % in total of at least one element selected from Mg, Si, Cu, Zn, Mn, Ni, Cr and Zr, the balance being Al and incidental impurities; performing solution heat treatment by heating the sheet material; cold rolling the solution heat treated sheet material; forming a developed terminal material by punching the cold-rolled sheet material into a developed view geometry of a terminal; forming a metal coating layer over a part of or an entirety of the developed terminal material, the metal coating layer being composed of Sn, Cr, Cu, Zn, Au or Ag or an alloy composed primarily thereof;

forming the developed terminal on which the metal coating layer is formed into a terminal; and performing an aging treatment on the terminal under a condition of 150° C. to 190° C. for 60 to 600 minutes.

It is preferable that the above-mentioned methods of manufacturing a terminal further include forming an undercoat layer between the sheet material and the metal coating layer.

A method of manufacturing a terminal according to the present disclosure provides a preferable method of manufacturing a terminal.

DESCRIPTION OF THE EMBODIMENTS

Further features of the present disclosure will become apparent from the following detailed description of exemplary embodiments with reference to the accompanying drawings.

(Metal Member Constituting a Terminal)

Figure 1A:
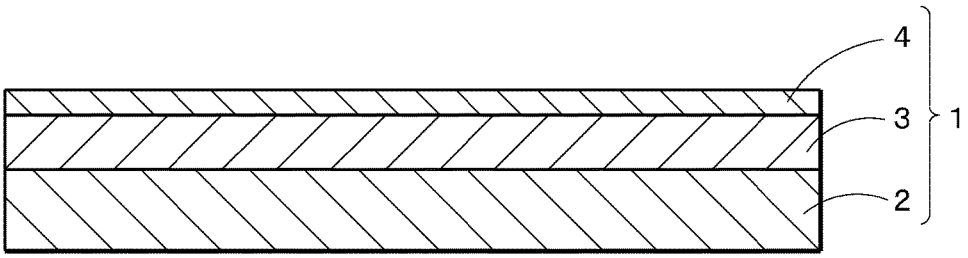
FIGS. 1A and 1B are diagrams schematically showing a constitution of a metal member forming a terminal according to the present embodiment.
Figure 1B:
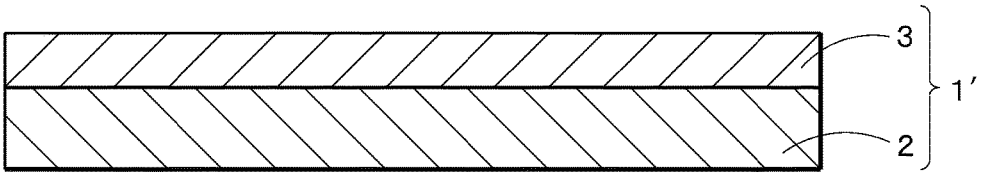

FIGS. 1A and 1B are diagrams schematically showing a metal member constituting a terminal according to the present embodiment. As shown in FIGS. 1A and 1B, a metal member 1 includes a base material 2, a metal coating layer 3 disposed over the base material 2, and an oxide layer 4 disposed over the metal coating layer 3.

The base material 2 is a base material composed of an aluminum alloy. It has a composition comprising 0.005 mass % to 3.000 mass % in total of at least one element selected from Mg, Si, Cu, Zn, Mn, Ni, Cr and Zr, the balance being Al and incidental impurities. Preferably, it is a composition composed of at least one element selected from Mg, Si, Cu, Mn and Cr contained by 1.000 mass % to 2.300 mass % in total, a balance including Al and incidental impurities.

Mg forms $Mg_2Si$ together with Si, and plays a role of increasing the strength of a material. Si forms $Mg_2Si$ together with Mg, and plays a role of increasing the strength of a material. Cu accelerates formation of $Mg_2Si$ and forms an Al—Cu based precipitate, and plays a role of increasing the strength of a material. Zn forms $MgZn_2$ together with Mg, and plays a role of increasing the strength of a material. Mn forms an Al—Mn based precipitate and plays a role of increasing the strength of a material. Ni, Zr, and Cr play a role of improving heat resistance. Therefore, in a case where the content of a composition composed of at least one element selected from Mg, Si, Cu, Zn, Mn, Ni, Cr and Zr is less than 0.005 mass % in total, an effect of increasing the strength of the material is small. On the other hand, in a case where the content is greater than 3.000 mass % in total, an effect of increasing the strength of a materials is saturated. Further, since it causes corrosion of an aluminum matrix to progress in a solid solution state or accelerates intermetallic corrosion with an aluminum matrix with elements that did not come to a solid solution state and existing on the surface, it causes deterioration in corrosion resistance. In addition, Fe may be contained, for example, as an amount of impurities originating from a raw material, and can be contained if an amount is less than or equal to 0.200 mass %. Since the content exceeding 0.200 mass % is likely to cause degradation of corrosion-resistance and degradation of toughness, it is attempted as much as possible not to exceed 0.200 mass %. It is to be noted that the elements such as Mg, Si, Cu, Zn, Mn, Ni, Cr and Zr need not necessarily form an intermetallic compound with other elements in an alloy, and may exist in a single phase.

In an alloy structure of the base material 2, there are greater than or equal to 500 precipitates/$\mu m^2$ and the precipitate has an average particle size of 10 nm to 100 nm. In a case where the density of the precipitate is less than 500 precipitates/$\mu m^2$, the strength (yield strength) and stress relaxation resistance, which are required for an aluminum alloy to maintain a sufficient terminal contact force, become insufficient. Usually, such fine and dispersed precipitates are obtained applying a solution heat treatment and an aging treatment on the base material 2. However, in a case where a sheet-shaped base material 2 has a precipitate density of greater than or equal to 500 precipitates/$\mu m^2$, when forming it into a shape of a terminal, there is a drawback that the workability and formability is poor due to its high strength. In other words, working into a terminal is difficult, since a crack is likely to occur in bending or the like during the working into a shape of a terminal. Therefore, it is not preferable to form the base material 2 subjected to a solution heat treatment and an aging treatment into a terminal. Accordingly, in the present embodiment, the base material 2 subjected to a solution heat treatment is processed into a shape of a terminal, and thereafter an aging treatment is performed on the terminal. In this manner, a terminal including a base material 2 having greater than or equal to 500 precipitates/$\mu m^2$ is obtained and an average particle size of the precipitate is 10 nm to 100 nm.

The metal coating layer 3 is a layer disposed over a part of or an entirety of the base material 2. Usually, it is provided for preventing corrosion and improving contact characteristics. It is disposed over a part of or an entirety, since it needs to be provided only at a necessary portion on the base material 2 (a portion necessary for surface characteristics of the terminal after formation of the final terminal). The metal coating layer 3 comprises, for example, Sn or an alloy composed primarily of Sn. An alloy composed primarily of Sn means an alloy in which Sn content is greater than 50% by mass. Note that, as the metal coating layer 3, it is preferable that Sn content is greater than 80% by mass. In the present embodiment, a single layer of the metal coating layer 3 composed of Sn formed on the base material 2 is given by way of example, but two or more layers of the metal coating layer 3 may be provided. Further, as an undercoat of the metal coating layer 3, an undercoat layer (not shown) comprising nickel, cobalt or an alloy composed primarily of nickel or cobalt may be provided. An undercoat layer is a layer disposed between the base material 2 and the metal coating layer 3 for the purpose of improving adhesion of the metal coating layer 3 and preventing diffusion of components of each other between the base material 2 and the metal coating layer 3. The metal coating layer 3 has a thickness (layer thickness) of usually 0.2 μm to 2.0 μm considering its function. The metal coating layer 3 is usually provided by plating, but it is not limited thereto.

The oxide layer 4 is a layer disposed over the metal coating layer 3, and composed primarily of an oxide of the metal of the metal coating layer. Therefore, in a case where the metal coating layer 3 comprises Sn or an alloy composed primarily of Sn, the oxide layer 4 is also a layer composed of an oxide of Sn or an alloy composed primarily of Sn, and oxidized Sn ($SnO_2$, etc.) is the major component. Even if the oxide layer 4 does not satisfy the crystal structure of oxidized Sn, it is sufficient if it is equivalent to an oxide film disposed over the metal coating layer 3. In a design of the terminal, the oxide layer 4 is usually an unintended layer. Since the terminal according to the present disclosure is manufactured by being worked into a shape of a terminal and thereafter subjected to an aging treatment, the surface of the metal coating layer 3 is oxidized. Here, if the aging treatment is performed unconditionally, there may be problems such as the melting of Sn or an alloy composed primarily of Sn or an excessively thick oxide layer. Therefore, in order not to impair the contact characteristics of the metal coating layer 3, the thickness of the oxide layer 4 is made to be less than or equal to 50 nm. In a case where the thickness is greater than 50 nm, because of a high electric resistivity of the oxide layer, the contact resistance as a terminal increases and cannot satisfy the contact characteristics.

Alternatively, the metal coating layer 3 may be composed of a metal other than Sn or an alloy composed primarily of Sn, and the oxide layer 4 may be composed primarily of an oxide of such metal. In other words, in a case where the metal coating layer 3 is composed of metal X or an alloy composed primarily of X, the oxide layer 4 may be composed primarily of an oxide of metal X. In the present embodiment, an element of metal X may be, in addition to Sn described above, selected from Cr, Cu, Zn, Au and Ag.

It is to be noted that, in a case where metal X is Au, although Au is not oxidized under the manufacturing condition according to the present embodiment, there may be a case where an oxide layer composed primarily of Au is formed under a special condition, and such a case also falls within the present disclosure. Also, even in a case where metal X is other than Au, the oxide layer 4 is not always detected because of the detection limit. As described above, in the present disclosure, the oxide layer 4 is formed unintentionally, and not positively formed, and thus it is not an essential feature. Therefore, as shown in FIG. 1B, it may be a structure in which a metal member 1' includes a base material 2 and a metal film layer 3 formed on the base material 2, and an oxide layer 4 is not formed on the metal coating layer 3.

(Terminal)

Figure 2:
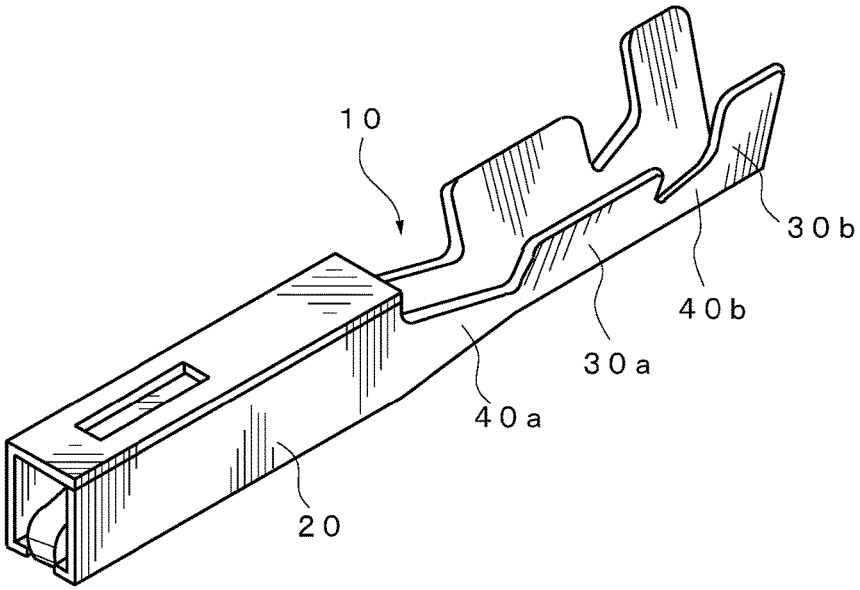
FIG. 2 is a perspective view showing an aluminum alloy terminal according to the present embodiment.

FIG. 2 is a perspective view of a terminal according to the present embodiment.

A terminal 10 has a terminal connecting portion 20, a conductor connecting portion 30*a* to be connected to a conductor portion of an electric wire, and a coated wire connecting portion 30*b* to be connected to an insulating coating portion of the electric wire, and the terminal connecting portion 20 and the conductor connecting portion 30*a* are linked via a first transition portion 40*a*, and the conductor connecting portion 30*a* and the coated wire connecting portion 30*b* are linked via a second transition portion 40*b*. The terminal according to the present embodiment constitutes, for example, a wire harness by being connected to a coated wire and thereafter housed in a connector housing. It is to be noted, although the terminal of the present embodiment is illustrated as a female type terminal by way of example, it may be a male type terminal. Also, although the terminal of the present embodiment is a terminal in which a portion to be connected to a coated wire is of a so-called opening barrel type, it may be of a structure in which the portion to be connected to a coated wire is closed, which is a closed-barrel type.

(Method of Manufacturing a Terminal)

A method of manufacturing a terminal of the present embodiment will be described.

A first method of manufacturing the terminal of the present embodiment includes, in the following order: a sheet material preparation step of preparing a sheet material comprising greater than or equal to 0.005 mass % and less than or equal to 3.000 mass % in total of at least one element selected from Mg, Si, Cu, Zn, Mn, Ni, Cr and Zr, the balance being Al and incidental impurities; a solution heat treatment step of performing solution heat treatment by heating the sheet material; a cold rolling step of cold rolling the solution heat treated sheet material; a metal coating layer forming step of forming a metal coating layer 3 over a part of or an entirety of the cold-rolled sheet material, the metal coating layer comprising, for example, Sn or an alloy composed primarily of Sn; a first terminal working step of forming a developed terminal material by punching the base material on which the metal coating layer 3 is formed into a developed view geometry of a terminal 10; a second terminal working step of forming the developed terminal into a terminal 10; and an aging step of performing an aging treatment on the terminal 10.

<Sheet Material Preparing Step>

In this step, an aluminum alloy having the aforementioned composition is dissolved and thereafter a process such a half continuous casting method is performed to obtain an aluminum alloy ingot. Thereafter, processes such as a homogenizing process, a hot working process and a cold working process are performed to obtain a sheet material having a desired alloy composition. These processes and steps can be usually performed by known methods. The entire process steps to be conducted until the solution heat treatment step, which is a subsequent step, can be generally referred to as a sheet material preparing step.

<Solution Heat Treatment Step>

Then, solution heat treatment is carried out on the sheet material. By carrying out this process, precipitates and crystallized substances which were segregated in the sheet material (base material) can be supersaturated in a solid solution in an aluminum matrix of the sheet material. When a solution heat treatment is performed outside the aforementioned ranges of temperature and time, it is likely that the solid solution heat treatment of the alloying element to become precipitates is not performed sufficiently, and may cause a lack of strength after the aging treatment. It is preferable that solution heat treatment is performed by maintaining 300° C. to 550° C. for one second to 180 minutes, and thereafter quenching to room temperature.

<Cold Rolling Step>

The sheet material subjected to the solution heat treatment is cold-rolled. The cold rolling is preferably conducted at a reduction ratio of less than or equal to 90%. Various conditions of the sheet material such as a sheet thickness are adjusted. A cold-rolling reduction ratio of greater than 90% is not preferable, since the sheet material may become too hard. The reduction ratio is defined by an expression indicated below.

Reduction ratio (%)={(sheet thickness before rolling)−(sheet thickness after rolling)}×100/(sheet thickness before rolling)

<Metal Coating Layer Forming Step>

Subsequently, a metal coating layer comprising Sn or an alloy composed primarily of Sn is formed over a part of or an entirety of the sheet material. Depending on the case, the metal coating layer 3 may be provided after having applied an undercoat layer. A method of forming the metal coating layer 3 is not particularly limited. The metal coating layer forming step may include steps such as a degreasing step, a passive state film removing step, a zincate process step, and an undercoat layer forming step. The metal coating layer forming step includes, for example, applying a Ni undercoat layer on a surface of the sheet material by plating, and thereafter providing Sn as a metal coating layer on the Ni undercoat layer by plating. The undercoat layer forming step includes performing a Zn plating process, and thereafter performing displacement plating with Zn to provide an undercoat layer.

<First Terminal Working Step>

Figure 3A:
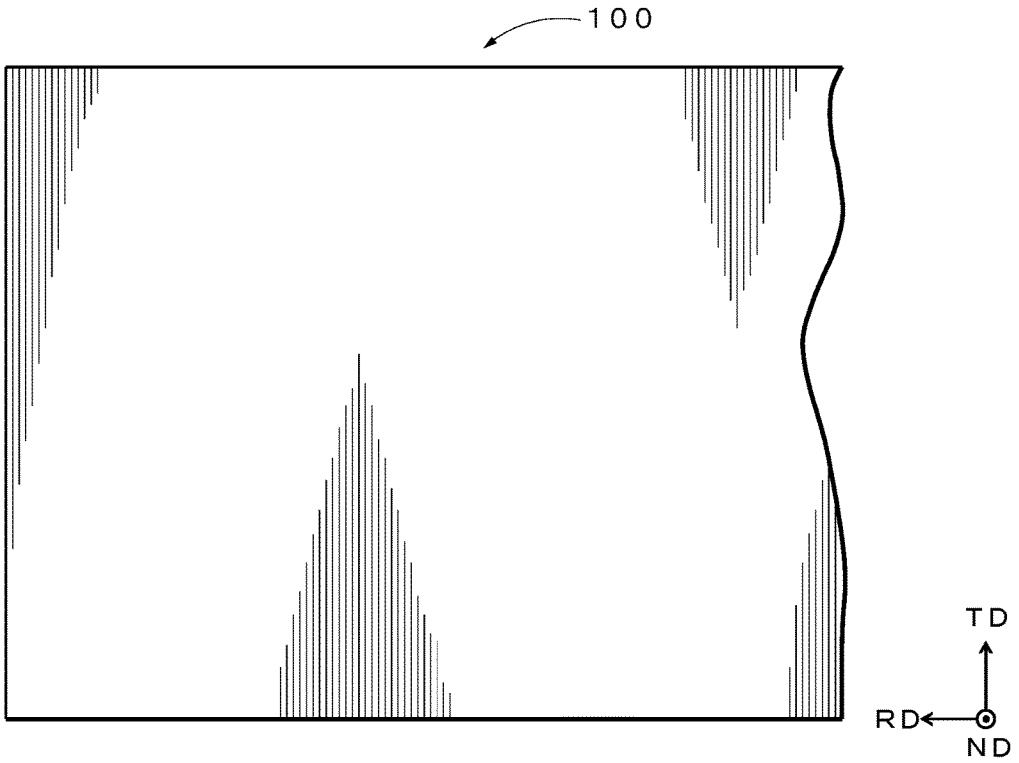
FIG. 3A is a plan view of an aluminum alloy strip used for manufacturing of an aluminum alloy terminal of the present embodiment.
Figure 3B:
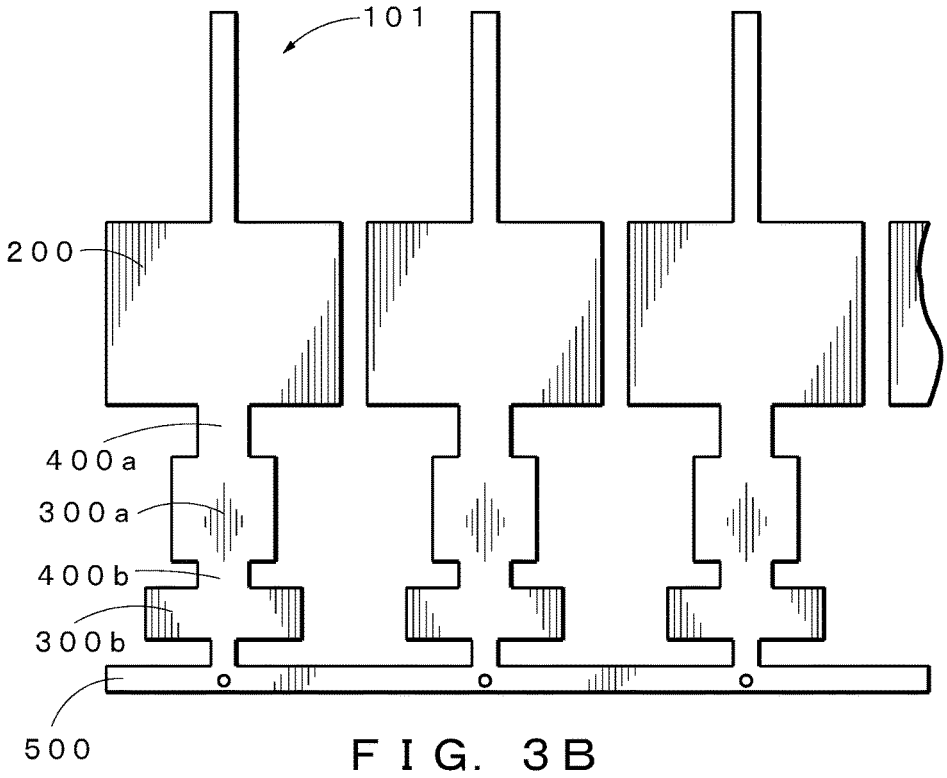
FIG. 3B is a plan view of a terminal developed material used for manufacturing an aluminum alloy terminal of the present embodiment.
Figures 4A, 4B:
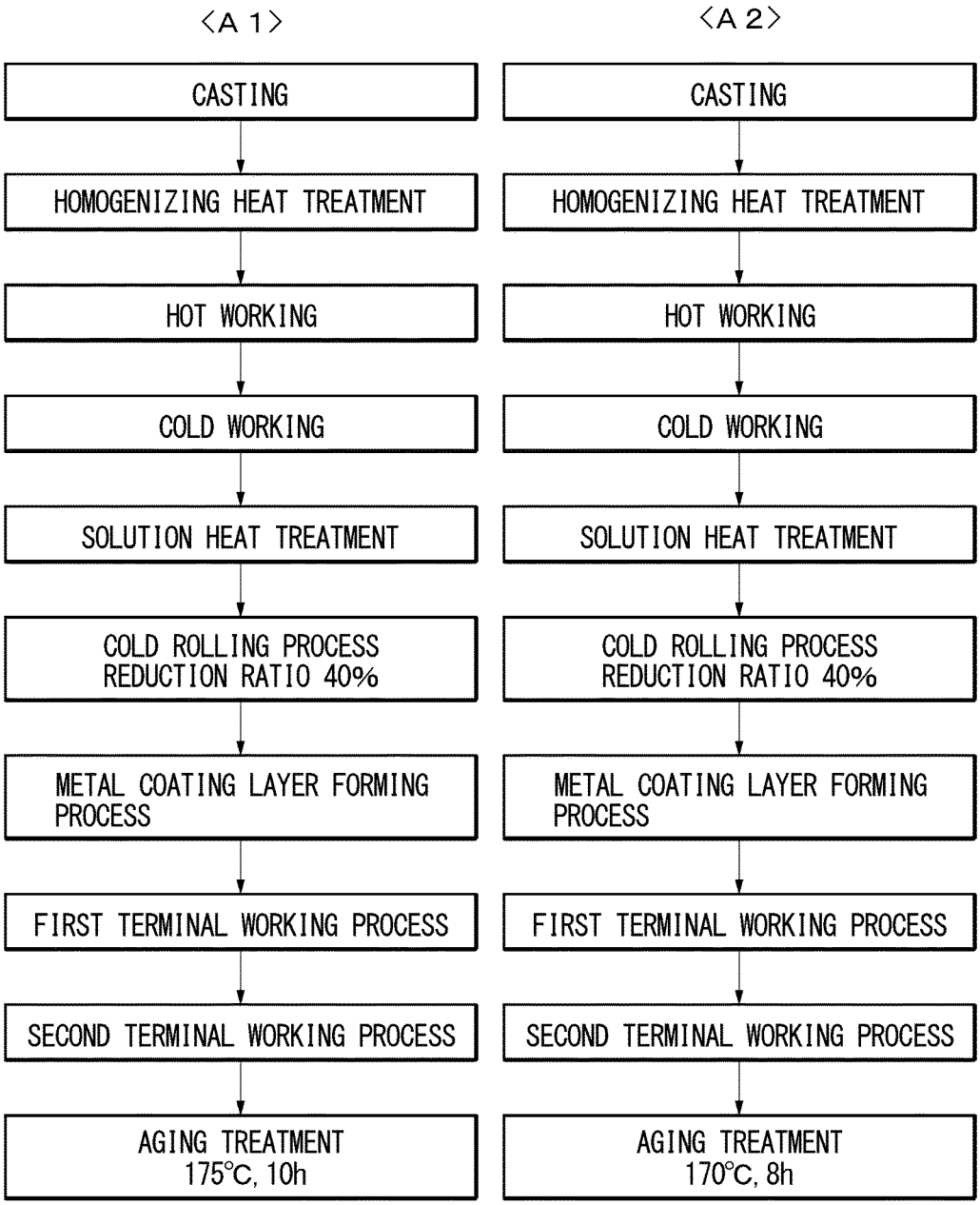
FIGS. 4A to 4E are diagrams for explaining a method of manufacturing the terminal.
Figure 4C:
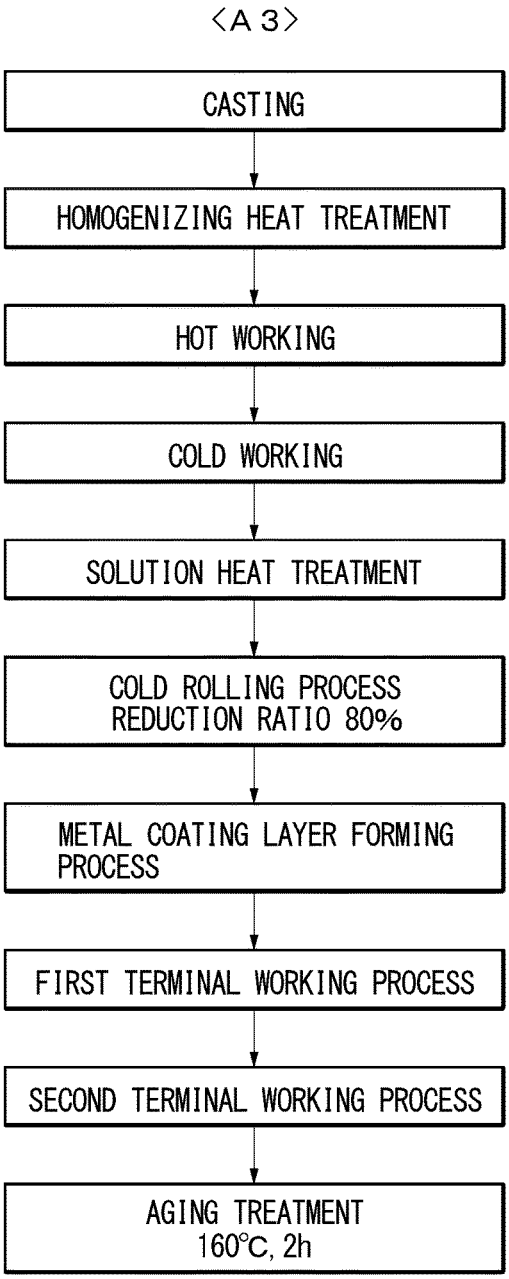
Figure 4D:
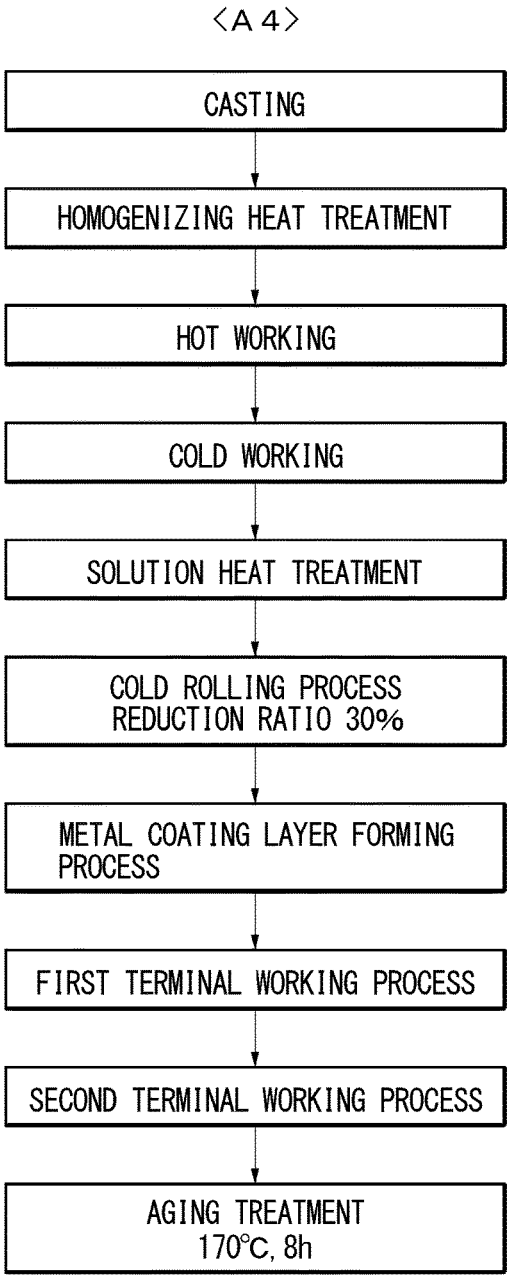
Figure 4E:
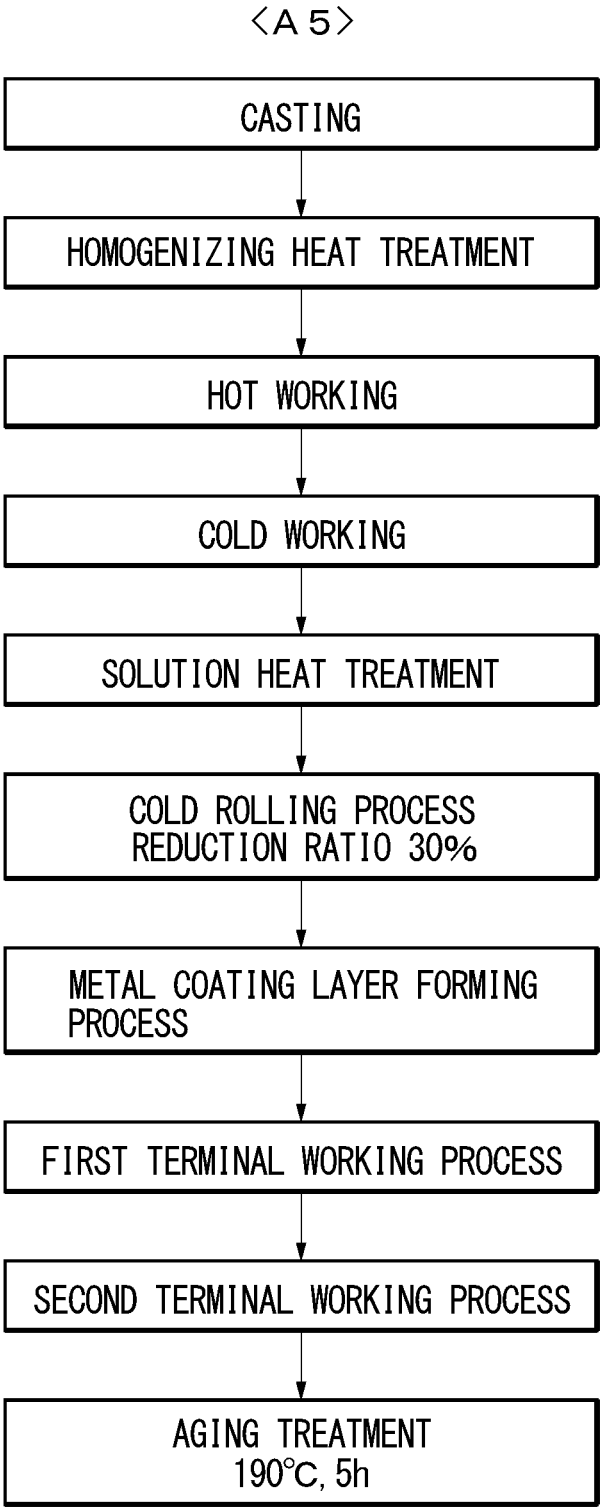
Figure 5A:
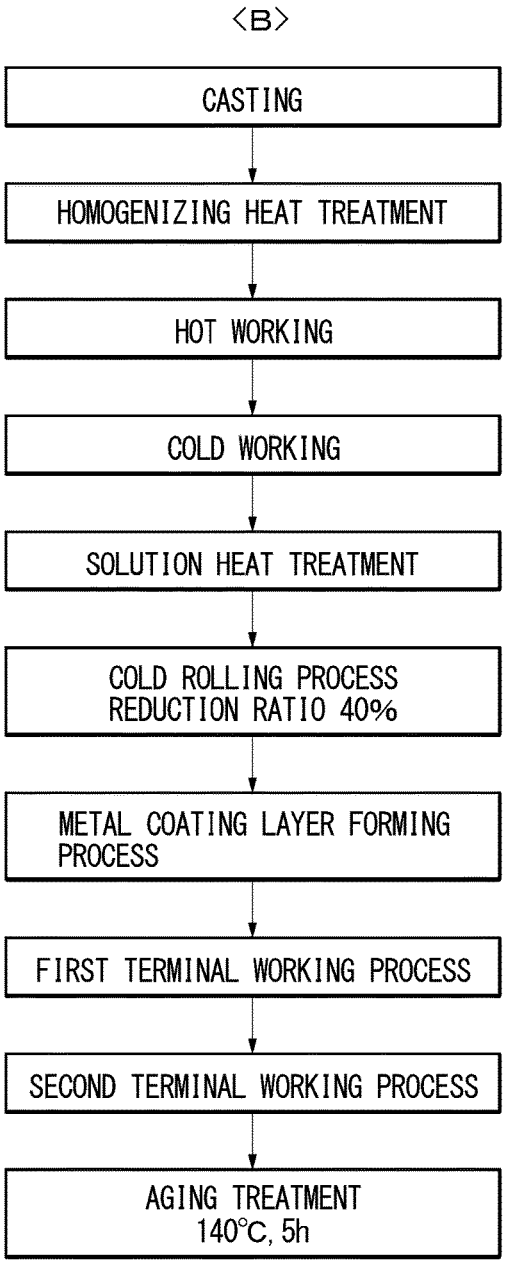
FIGS. 5A to 5J are diagrams for explaining a method of manufacturing the terminal.
Figure 5B:
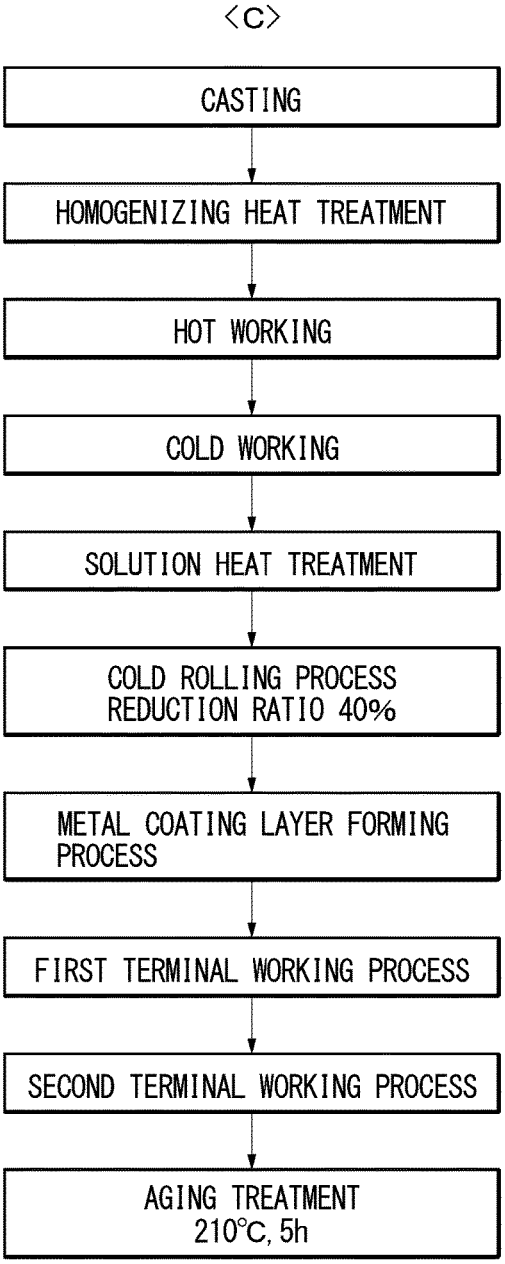
Figure 5C:
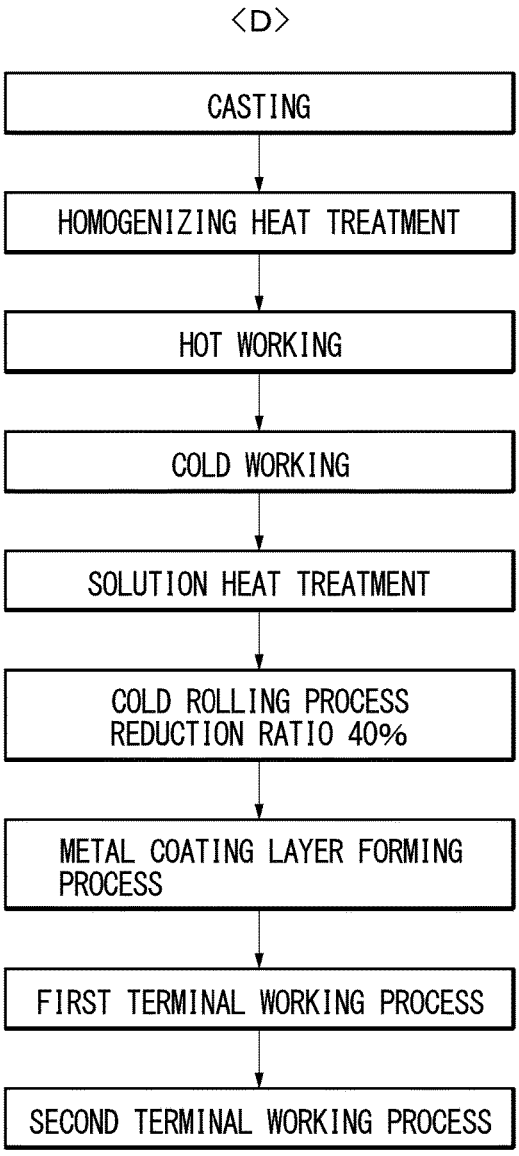
Figure 5D:
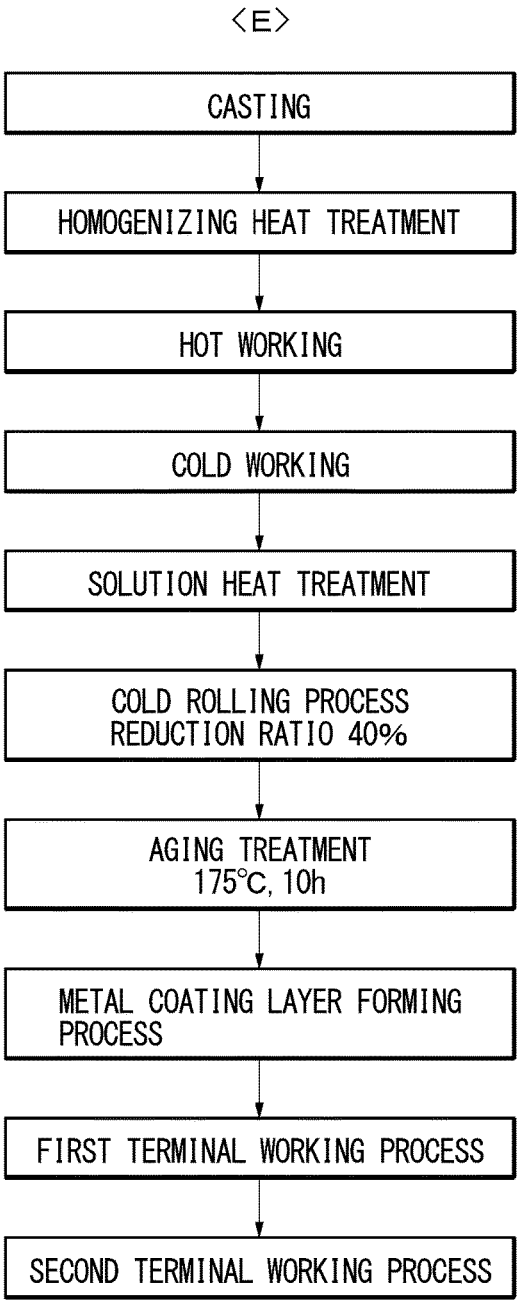
Figure 5E:
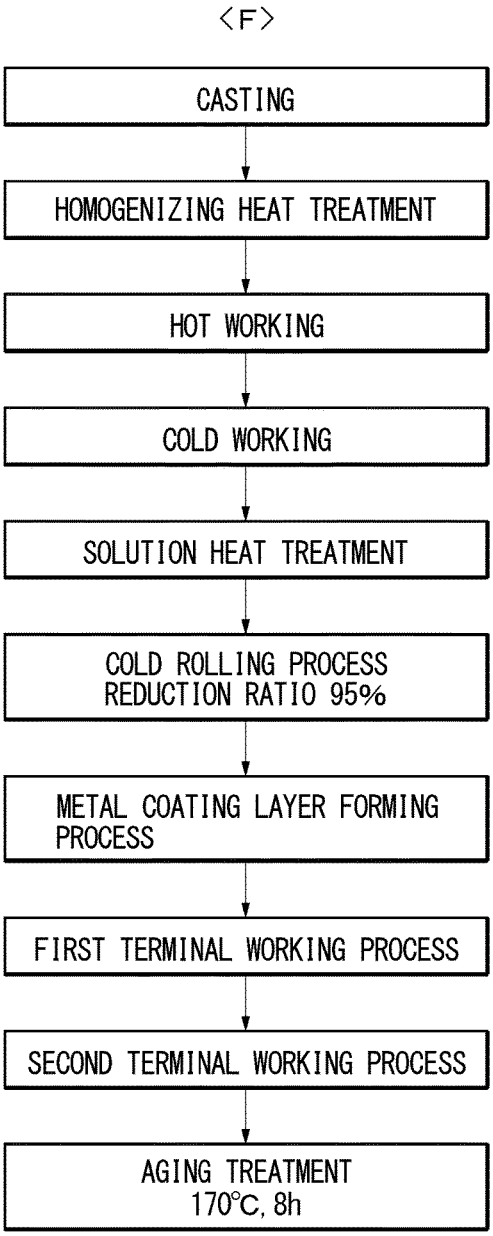
Figure 5F:
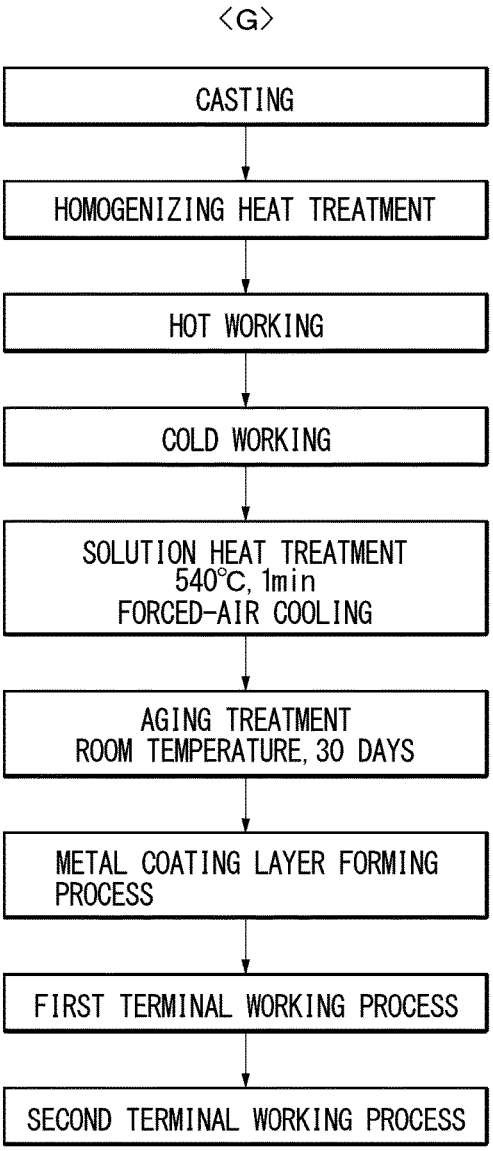
Figure 5G:
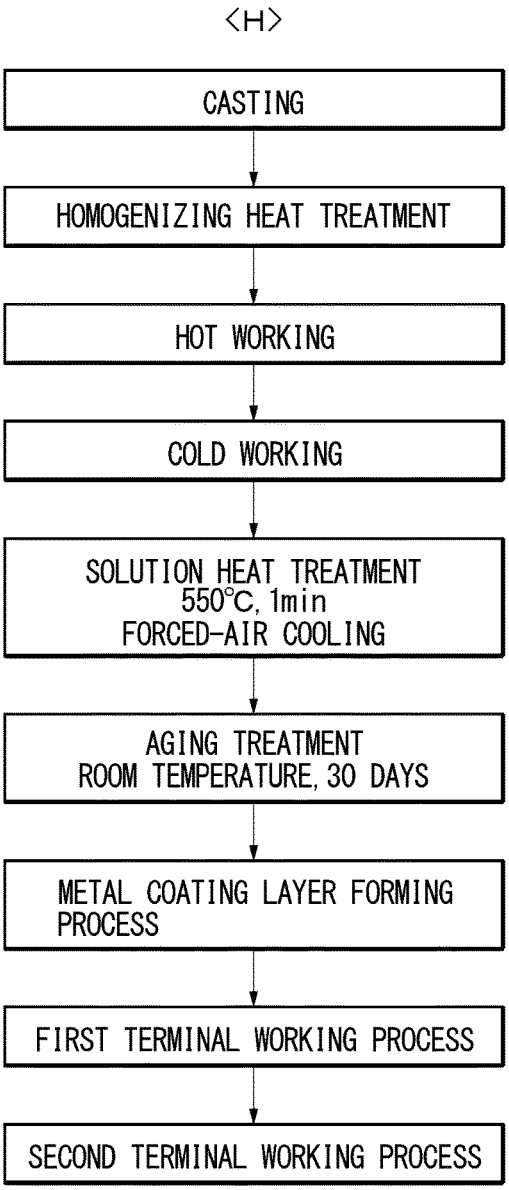
Figure 5H:
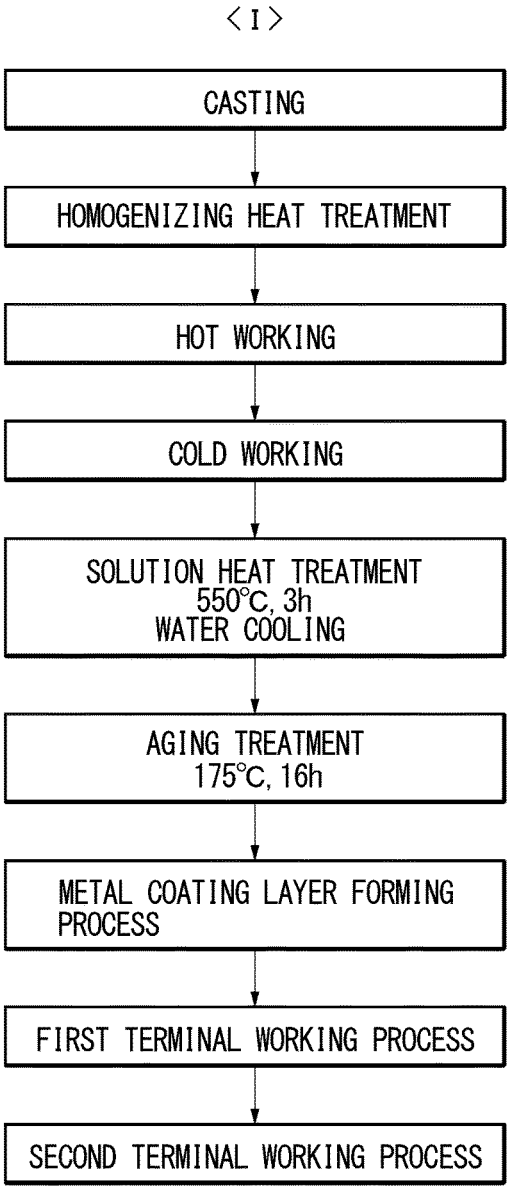
Figure 5I:
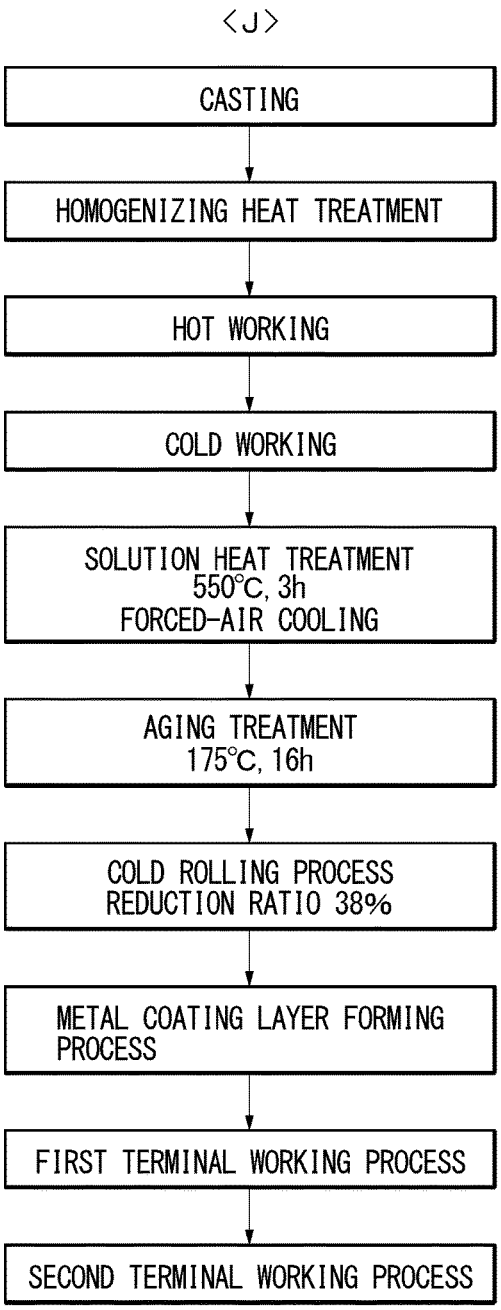
Figure 5J:
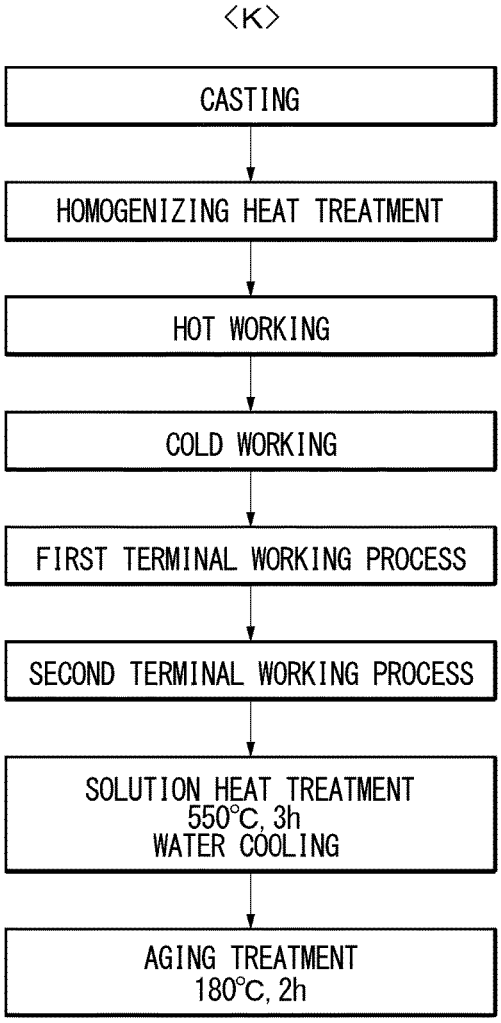

The sheet material on which the metal coating layer 3 is formed is punched in a developed view geometry of the terminal 10. FIGS. 3A and 3B show how this is performed. FIG. 3A is a plan view of a sheet material 100 on which the metal coating layer 3 is formed. RD indicates a rolling direction, TD indicates a direction perpendicular to the rolling direction, and ND indicates a direction perpendicular to a rolling surface. In the terminal working step, the sheet material 100 is punched into a terminal shape which is developed into a planar geometry to obtain a developed terminal material 101 as shown in FIG. 3B. The developed terminal material 101 is an integrally linked body including a terminal connecting portion sheet material 200 which becomes a terminal connecting portion 20 after the working, a conductor connecting portion sheet material 300*a* which becomes a conductor connecting portion 30*a* after the working, a coated wire connecting portion sheet material 300*b* which becomes a coated wire connecting portion 30*b* after the working, a first transition portion sheet material 400*a* and a second transition portion base material 400*b* which become the first transition portion 40*a* and the second transition portion 40*b*, respectively, after the working. It is to be noted that the metal coating layer may be formed over an entirety of the surface of the developed terminal material 101, or may be formed at least on (1) a surface of the conductor connecting portion base material 300*a* to be connected to the coated wire electric conductor, and (2) a portion of the terminal connecting portion sheet material 200 to be connected to another terminal.

<Second Terminal Working Step>

Subsequently, the developed terminal material 101 is formed into a final terminal shape. The terminal 10 of the present embodiment is manufactured by bending the developed terminal material 101. During or after this working, the respective terminals are separated from the linking portion 500 to obtain terminals. Alternatively, the respective terminals may be in a state where they remain linked by a linking portion 500. In the present specification, those which have a terminal configuration immediately before separation is referred to as a terminal 10 similarly to those after separation, even they are in a state where they are linked with the linking portion 500.

<Aging Step>

Finally, an aging treatment is applied on the terminal 10. The aging treatment is a step of performing precipitation to obtain a precipitate from the alloying element, which had been supersaturated as a solid solution in an aluminum matrix in the solution heat treatment step. With this step, a homogeneous fine precipitate is obtained by precipitation in the base material constituting the terminal, and improves the strength. Also, this increase in strength leads to an increase in the stress relaxation resistance. If this aging treatment is not performed as the final step, the strength of the sheet material will become high, and thus it becomes difficult to form the sheet material into a shape of the terminal. Also, with this aging step, an oxide layer 4 is formed on the metal coating layer 3.

As to the setting of the aging temperature, when the aging temperature is too high, the oxide layer 4 becomes too thick, and thus the contact resistance is likely to increase, and when the melting point of the metal coating layer is lower than the aging temperature, the metal coating layer 3 may melt. Also, when the temperature of the aging treatment is too low, aging becomes insufficient, and the strength and the stress relaxation resistance become insufficient.

Taking the above-mentioned conditions into consideration, in a case where the metal coating layer 3 is, for example, composed of Sn or Sn alloy, since the melting point of pure Sn is 232° C., it is preferable to perform the aging treatment at 150 to 190° C. for 60 to 600 minutes. In a case where the metal coating layer 3 is composed of an element other than Sn or Sn alloy, manufacturing conditions may be set as appropriate while taking the above-mentioned conditions into consideration.

The method of manufacturing the terminal according to the present embodiment has been described above, but the manufacturing method of may include a metal coating forming process and a first terminal working step in a reversed order. In other words, a method of manufacturing a terminal may include, in the following order: a sheet material preparation step of preparing a sheet material comprising greater than or equal to 0.005 mass % and less than or equal to 3.000 mass % in total of at least one element selected from Mg, Si, Cu, Zn, Mn, Ni, Cr and Zr, the balance being Al and incidental impurities; a solution heat treatment step of performing solution heat treatment by heating the sheet material; a cold rolling step of cold rolling the solution heat treated sheet material; a first terminal working step of forming a developed terminal material by punching the cold-rolled sheet material into a developed view geometry of a terminal; a metal coating layer forming step of forming a metal coating layer 3 over a part of or an entirety of the developed terminal material, the metal coating layer comprising Sn or an alloy composed primarily of Sn; a second terminal working step of forming the developed terminal material on which the metal coating layer 3 is formed into a terminal; and an aging step of performing an aging treatment on the terminal. With this manufacturing method, since the metal coating layer 3 is provided after having punched the developed terminal material 101, the metal coating layer 3 can be disposed to reach an end face (cut area) of the developed terminal material 101.

As described above, the terminal of the present embodiment is a terminal including a base material 2 and a metal coating layer 3 disposed over a part of or an entirety of the base material 2, and an oxide layer on a surface of the metal coating layer 4, and the base material has a composition comprising 0.005 mass % to 3.000 mass % in total of at least one element selected from Mg, Si, Cu, Zn, Mn, Ni, Cr and Zr, the balance being Al and incidental impurities, and has greater than or equal to 500 precipitates/$\mu m^2$, the precipitate having an average particle size of 10 nm to 100 nm.

In a case where the metal coating layer 3 comprises, for example, Sn or an alloy composed primarily of Sn, since the oxide layer 4 is composed primarily of Sn oxide and has a thickness of less than or equal to 50 nm, it shows an improved strength, heat resistance as well as formability and workability, and show a low contact resistance initially and after an endurance test.

In a case where those other than Sn or an Sn alloy is used as the metal coating layer 3, by making the thickness of the metal oxide layer 4 to be less than or equal to 50 nm, it shows an improved strength, heat resistance as well as formability and workability, and shows a low contact resistance initially and after an endurance test. However, as described above, the structure does not necessarily have a metal oxide layer 4, and even in such a case, it shows an improved strength, heat resistance as well as formability and workability, and shows a low contact resistance initially and after an endurance test.

EXAMPLES

Hereinafter, the present disclosure will be described below based on Examples, but the present disclosure is not limited thereto.

Alloy compositions of alloy Nos. 1 to 9 are shown in Table 1. The unit is mass %. Blanks indicate that nothing has been added, and the balance is Al and incidental impurities.

TABLE 1

| Alloy No. | Mg | Si | Cu | Zn | Mn | Ni | Cr | Zr | Total | Al and Impurities |
|---|---|---|---|---|---|---|---|---|---|---|
| 1 | 1.000 | 0.600 | 0.350 | | | | 0.200 | | 2.150 | bal. |
| 2 | 0.450 | 1.150 | 0.700 | | 0.050 | | 0.040 | | 2.390 | bal. |
| 3 | 1.000 | | 0.250 | | 1.250 | | | | 2.500 | bal. |
| 4 | 0.600 | 1.000 | | | 0.050 | | 0.040 | | 1.690 | bal. |
| 5 | 1.000 | | 0.250 | 0.100 | 0.050 | 0.100 | 0.200 | 0.100 | 1.800 | bal. |
| 6 | 0.001 | 0.001 | | | | | | | ***0.002*** | bal. |
| 7 | 0.500 | 0.700 | 4.500 | | 0.800 | | | | ***6.500*** | bal. |
| 8 | 4.500 | | | | 0.350 | | | | ***4.850*** | bal. |
| 9 | 0.700 | | | 4.500 | | | | 0.150 | ***5.350*** | bal. |

N.B. NUMERICAL VALUES IN BOLD ITALIC IN THE TABLE ARE OUT OF APPROPRIATE RANGE OF EXAMPLE

FIGS. 4A to 4E and FIGS. 5A to 5J show manufacturing conditions A1 to A5, and B to K. Each of the manufacturing conditions A1 to A5 and B to F includes, until an intermediate step, applying homogenization heat treatment, hot working, cold working, and solution heat treatment. Each condition is a general condition that is commonly performed. As for manufacturing conditions A1 to A5, and B to F, only the cold rolling process and subsequent steps will be described.

A1: cold rolling process with a cold rolling rate of 40%, metal coating layer forming process, first terminal working process, second terminal working process, aging treatment at 175° C. for 10 h A2: cold rolling process with a cold rolling rate of 40%, metal coating layer forming process, first terminal working process, second terminal working process, aging treatment at 170° C. for 8 h A3: cold rolling process with a cold rolling rate of 80%, metal coating layer forming process, first terminal working process, second terminal working process, aging treatment at 160° C. for 2 h A4: cold rolling process with a cold rolling rate of 30%, metal coating layer forming process, first terminal working process, second terminal working process, aging treatment at 170° C. for 8 h A5: cold rolling process with a cold rolling rate of 30%, metal coating layer forming process, first terminal working process, second terminal working process, aging treatment at 190° C. for 5 h In Comparative Examples 5 to 19, and 22 to 27, the cold rolling process and subsequent steps are carried out under manufacturing conditions B to F described below.

B: cold rolling process with a cold rolling rate of 40%, metal coating layer forming process, first terminal working process, second terminal working process, aging treatment at 140° C. for 5 h C: cold rolling process with a cold rolling rate of 40%, metal coating layer forming process, first terminal working process, second terminal working process, aging treatment at 210° C. for 5 h D: cold rolling process with a cold rolling rate of 40%, metal coating layer forming process, first terminal working process, second terminal working process E: cold rolling process with a cold rolling rate of 40%, aging treatment at 175° C. for 10 h, metal coating layer forming process, first terminal working process, second terminal working process F: cold rolling process with a cold rolling rate of 95%, metal coating layer forming process, first terminal working process, second terminal working process, aging treatment at 170° C. for 8 h In Comparative Examples 20, 21, 28 and 29, manufacturing conditions G to J described below were performed.

G: Casting, homogenizing process, hot rolling process, cold rolling process, solution heat treatment including maintaining at 540° C. for 1 min and thereafter forced-air cooling, aging treatment at room temperature for 30 days, metal coating layer forming process, first terminal working process, second terminal working process H: Casting, homogenizing process, hot rolling process, cold rolling process, solution heat treatment including maintaining at 550° C. for 1 min and thereafter forced-air cooling, aging treatment at room temperature for 30 days, metal coating layer forming process, first terminal working process, second terminal working process I: Casting, homogenizing process, hot rolling process, cold rolling process, solution heat treatment including maintaining at 550° C. for 3 h and thereafter water cooling, aging treatment at 175° C. for 16 h, metal coating layer forming process, first terminal working process, second terminal working process J: Casting, homogenizing process, hot rolling process, cold rolling process, solution heat treatment including maintaining at 550° C. for 3 h and thereafter water cooling, aging treatment at 175° C. for 16 h, cold rolling process with a cold rolling rate of 38%, metal coating layer forming process, first terminal working process, second terminal working process K: Casting, homogenizing process, hot rolling process, cold rolling process, first terminal working process, second terminal working process, solution heat treatment including maintaining at 550° C. for 3 h and thereafter water cooling and thereafter cooling at 100° C./s, aging treatment at 180° C. for 2 h It is to be noted that in metal coating layer forming process of each of the above, a zincate process step was performed after removing a passivation film at an aluminum alloy surface. Thereafter, an undercoat layer forming step was performed including displacement plating of Zn and Ni is performed to form a 1 μm-thick Ni undercoat layer. Further, a plating process of 1 μm-thick Sn was performed.

Also, with an alloy composition of the base material being Alloy No. 1 in Table 1, a plating process performed respectively such that an outermost layer of the metal coating layer is a film composed of one of Sn, Cr, Cu, Zn, Au and Ag (see Film Nos. 1 to 6 in Table 6) and manufactured with one of manufacturing conditions A1 and B to D.

An analysis method of the terminal will be described below.

(1) Density of Precipitates

The density of precipitates existing in the aluminum alloy constituting the terminal was measured using SEM (scanning electron microscope) or TEM (transmission electron microscope). At a magnification of 10,000 to 100,000, the number of precipitates in a field of view in which at least 200 precipitates are identified was counted up and converted into number of precipitates per unit area ($\mu m^2$).

(2) Thickness of Oxide Layer

For samples having a small film thickness of less than 20 nm, an Auger electron spectroscopy apparatus (scanning Auger electron spectroscopy apparatus model SAM 680, manufactured by Ulvac phi, Inc.,) was used, and cutting and Auger electron spectroscopy were repeated in a film thickness direction until the oxide layer no longer exists and the total cutting depth at this point was identified as the thickness of the oxide layer. For samples having a film thickness of greater than or equal to 20 nm, the cutting of the samples as described above was not carried out, and the film thickness was determined by an actual observation of a secondary electron image and a reflection electron image of SEM, and an accompanying EDX analyzer device (device name "7021-H" manufactured by Horiba, Ltd.). Concerning the accuracy of measurement, the film thickness is determined with 5 nm increments, and in the Examples, "less than 5 nm" is expressed as "<5 nm". However, in practice, it is considered that an oxide layer of a very small thickness (0<) exists, and even if it is "<5 nm" in each Example, it is falls within the scope of the present disclosure.

Hereinafter, an evaluation method of the terminal will be described.

a. Yield Strength [YS]:

In order to measure the strength of the metal member of the terminal, a strength test should be performed after being formed into a terminal shape, but since it is not easy to perform the test after formation of the terminal, a test piece is cut out from the sheet-shaped metal member for carrying out the measurement. In order to simulate the state of the terminals manufactured under the conditions A1 to 5, and B to J described above, each test piece is cut out from a metal member obtained under the conditions excluding the first terminal working process and the second terminal working process from each condition. For example, as a simulation material of a terminal obtained under condition A1, a metal material obtained by performing casting, homogenizing heat treatment, hot working, cold working, solution heat treatment, cold rolling process with a cold rolling rate of 40%, metal coating layer forming process, aging treatment at 170° C. for 10 h, in this order is used.

For the measurement of the yield strength, test pieces conforming to JIS Z2201-13B cut out from the metal member in a direction parallel to rolling were used and measurement was carried out on three test pieces in accordance with JIS Z2241, and an average value was taken. A case where the yield strength was greater than or equal to 230 MPa was determined as a good result, and indicated with "○". On the other hand, a case where the yield strength was less than 230 MPa was determined as a poor result, and indicated with "×".

b. Stress Relaxation Ratio [SR]:

The measurement of the stress relaxation ratio is, similarly to the aforementioned section "a.", performed by testing a sheet-shaped metal member. In conformity with Japan Copper and Brass Association JCBA T309:2004 (stress relief testing method by bending a thin sheet material strip of copper and copper alloy), measurement was carried out under the condition after being maintained at 120° C. for 100 hours. Using a cantilever block-type jig, an initial stress of 80% of the yield strength was applied. A case in which the stress relaxation ratio was less than 50% was determined as a good result, and indicated with "○". On the other hand, a case where the stress relaxation ratio was greater than or equal to 50% was determined as a poor result, and indicated with "×".

c. Initial Contact Resistance

As a terminal of the present disclosure, terminals of a male type and a female type geometry, which are commonly manufactured as automobile terminals, were prepared and mated. Both ends were measured with a resistance measuring apparatus by a four-point probe method. Those showing a resistance of less than 5 mΩ were determined as a good result, and indicated with "○". On the other hand, those showing a resistance of greater than or equal to 5 mΩ was determined as a poor result, and indicated with "×".

d. Contact Resistance after Corrosion Test

The male terminal and the female terminal which were produced as trial pieces in the above-mentioned section "c." were mated and after leaving it in a 5% NaCl spraying environment for 96 h, both ends were measured with a four-point probe method using a resistance measuring apparatus. Those showing a resistance of less than 5 mΩ were determined as a good result, and indicated with "○". On the other hand, those showing a resistance of greater than or equal to 5 mΩ were determined as a poor result, and indicated with "×". In a case where it was not possible to maintain a contact condition, it was determined as a poor result, and indicated with "×". Note that this measurement test was performed only for a condition material which sufficiently satisfied an initial contact resistance.

e. Contact Resistance after Heat Treatment Test

The male terminal and the female terminal which were produced as trial pieces in the above-mentioned section "c." were mated and after leaving it in an atmospheric environment of 120° C. for 100 hours, both ends were measured with a four-point probe method using a resistance measuring apparatus. Those showing a resistance of less than 5 mΩ were determined as a good result, and indicated with "○". On the other hand, those showing a resistance of greater than or equal to 5 mΩ were determined as a poor result, and indicated with "×". Note that this measurement test was performed only for a condition material which sufficiently satisfied an initial contact resistance.

In Tables 2 to 4, evaluation results of the terminals manufactured with the respective manufacturing conditions (A1 to A5, B to D, G, H and K) on the respective alloy compositions (Alloy Nos. 1 to 9) are shown as Examples 1 to 5 and Comparative Examples 1 to 22.

In Table 5, evaluation results of the terminals manufactured with the respective manufacturing conditions (E, F, I, J) on the respective alloy compositions (Alloy Nos. 1 to 5) are shown as Comparative Examples 23 to 30.

TABLE 2

| | Alloy No. | Condition | Precipitation (numbers of particles/μm$^2$) | Thickness of Oxide Layer (nm) | Yield Strength | Stress Relaxation Ratio | Contact Resistance Initial | Contact Resistance After Corrosion Test | Contact Resistance After Heat Treatment Test |
|---|---|---|---|---|---|---|---|---|---|
| EXAMPLE 1 | 1 | A1 | 3500 | 15 | ○ | ○ | ○ | ○ | ○ |
| EXAMPLE 2 | 2 | A2 | 3200 | 20 | ○ | ○ | ○ | ○ | ○ |
| EXAMPLE 3 | 3 | A3 | 1500 | 15 | ○ | ○ | ○ | ○ | ○ |
| EXAMPLE 4 | 4 | A4 | 1000 | 15 | ○ | ○ | ○ | ○ | ○ |
| EXAMPLE 5 | 5 | A5 | 3000 | 15 | ○ | ○ | ○ | ○ | ○ |

TABLE 3

| | Alloy No. | Condition | Precipitation (numbers of particles/μm$^2$) | Thickness of Oxide Layer (nm) | Yield Strength | Stress Relaxation Ratio | Contact Resistance Initial | Contact Resistance After Corrosion Test | Contact Resistance After Heat Treatment Test |
|---|---|---|---|---|---|---|---|---|---|
| COMPARTIVE EXAMPLE 1 | 6 | A2 | ***0*** | 15 | X | X | X | — | — |
| COMPARTIVE EXAMPLE 2 | 7 | A2 | 5000 | 15 | ○ | ○ | ○ | X | ○ |
| COMPARTIVE EXAMPLE 3 | 8 | A2 | ***100*** | 15 | ○ | X | ○ | ○ | X |
| COMPARTIVE EXAMPLE 4 | 9 | A2 | 6000 | 15 | ○ | ○ | ○ | X | ○ |

N.B. NUMERICAL VALUES IN BOLD ITALIC IN THE TABLE ARE OUT OF APPROPRIATE RANGE OF EXAMPLE

TABLE 4

| | Alloy No. | Condition | Precipitation (numbers of particles/μm$^2$) | Thickness of Oxide Layer (nm) | Yield Strength | Stress Relaxation Ratio | Contact Resistance Initial |
|---|---|---|---|---|---|---|---|
| COMPARATIVE EXAMPLE 5 | 1 | B | ***300*** | 5 | X | X | X |
| COMPARATIVE EXAMPLE 6 | 1 | C | 2000 | ***70*** | ○ | ○ | X |
| COMPARATIVE EXAMPLE 7 | 1 | D | ***60*** | <5 | X | X | X |
| COMPARATIVE EXAMPLE 8 | 2 | B | ***400*** | 5 | X | X | X |
| COMPARATIVE EXAMPLE 9 | 2 | C | 2200 | ***100*** | ○ | ○ | X |
| COMPARATIVE EXAMPLE 10 | 2 | D | ***20*** | <5 | X | X | X |
| COMPARATIVE EXAMPLE 11 | 3 | B | ***40*** | 5 | X | X | X |
| COMPARATIVE EXAMPLE 12 | 3 | C | 1800 | ***120*** | ○ | ○ | X |
| COMPARATIVE EXAMPLE 13 | 3 | D | ***40*** | <5 | X | X | X |
| COMPARATIVE EXAMPLE 14 | 4 | B | ***400*** | 5 | X | X | X |
| COMPARATIVE EXAMPLE 15 | 4 | C | 2000 | ***80*** | ○ | ○ | X |
| COMPARATIVE EXAMPLE 16 | 4 | D | ***25*** | <5 | X | X | X |
| COMPARATIVE EXAMPLE 17 | 5 | B | ***200*** | 5 | X | X | X |
| COMPARATIVE EXAMPLE 18 | 5 | C | 2400 | ***70*** | ○ | ○ | X |
| COMPARATIVE EXAMPLE 19 | 5 | D | ***15*** | <5 | X | X | X |

TABLE 4-continued

| | Alloy No. | Condition | Precipitation (numbers of particles/μm²) | Thickness of Oxide Layer (nm) | Yield Strength | Stress Relaxation Ratio | Contact Resistance Initial |
|---|---|---|---|---|---|---|---|
| COMPARATIVE EXAMPLE 20 | 1 | G | ***300*** | 10 | X | X | X |
| COMPARATIVE EXAMPLE 21 | 1 | H | ***350*** | 10 | X | X | X |
| COMPARATIVE EXAMPLE 22 | 1 | K | 2000 | — | ○ | ○ | X |

N.B. NUMERICAL VALUES IN BOLD ITALIC IN THE TABLE ARE OUT OF APPROPRIATE RANGE OF EXAMPLE

TABLE 5

| | Alloy No. | Condition | Precipitation (numbers of particles/μm²) | Thickness of Oxide Layer (nm) | Condition of Processed Terminal | Yield Strength | Stress Relaxation Ratio | Contact Resistance Initial |
|---|---|---|---|---|---|---|---|---|
| COMPARATIVE EXAMPLE 23 | 1 | E | 2500 | <5 | Could not form into a terminal shape or a crack was produced when formed into a terminal shape | ○ | ○ | X |
| COMPARATIVE EXAMPLE 24 | 2 | E | 3000 | <5 | | ○ | ○ | X |
| COMPARATIVE EXAMPLE 25 | 3 | E | 3200 | <5 | | ○ | ○ | X |
| COMPARATIVE EXAMPLE 26 | 4 | E | 2800 | <5 | | ○ | ○ | X |
| COMPARATIVE EXAMPLE 27 | 5 | E | 2500 | <5 | | ○ | ○ | X |
| COMPARATIVE EXAMPLE 28 | 1 | F | 3700 | 15 | | ○ | X | X |
| COMPARATIVE EXAMPLE 29 | 1 | I | 3000 | <5 | | ○ | ○ | X |
| COMPARATIVE EXAMPLE 30 | 1 | J | 3000 | <5 | | ○ | ○ | X |

As shown in Table 2, it was found that, since the terminal of Examples 1 to 5 has a composition has a composition comprising 0.005 mass % to 3.000 mass % in total of at least one element selected from Mg, Si, Cu, Zn, Mn, Ni, Cr and Zr, the balance being Al and incidental impurities, and has greater than or equal to 500 precipitates/μm², the precipitate having an average particle size of 10 nm to 100 nm, the yield strength is greater than or equal to 230 MPa and the stress relaxation ratio is less than 50%. In other words, it was found that an improved strength and heat resistance are obtained. At the same time, it was found that, since the oxide layer composed primarily of Sn oxide has a thickness of less than or equal to 50 nm, the aluminum terminals of Examples 1 to 5 are low in their initial contact resistance, contact resistance after corrosion test and contact resistance after heat treatment.

Note that in each of Examples 1 to 5, since an aging step was performed after terminal formation, there is no increase in strength due to an aging precipitation effect at the time of terminal formation, and thus it was easy to perform the forming and working of a terminal.

On the other hand, as shown in Table 3, it was found that, since the terminal of Comparative Example 1 contains 0.002 mass % in total of at least one element selected from Mg, Si, Cu, Zn, Mn, Ni, Cr and Zr, and has zero precipitate/μm², the precipitate having an average particle size of 10 nm to 100 nm, the strength and heat resistance are poor. Also, it was found that the initial contact resistance is high, and that the terminal characteristic are not satisfied.

It was found that, since the terminals of Comparative Examples 2 and 4 contain greater than or equal to 3.000 mass % in total of at least one element selected from Mg, Si, Cu, Zn, Mn, Ni, Cr and Zr, there is an excessive amount of compound that could accelerate corrosion of aluminum which is a parent material, the contact resistance after corrosion test is high and the terminal characteristics are not satisfied.

It was found that, since the terminal of Comparative Example 3 contains 4.850 mass % in total of at least one element selected from Mg, Si, Cu, Zn, Mn, Ni, Cr and Zr and has 100 precipitates/μm², the precipitate having an average particle size of 10 nm to 100 nm, the heat resistance was poor. Also, it was found that the contact resistance after heat treatment test is high and the terminal characteristics are not satisfied.

As shown in Table 4, it was found that, since the terminals of Comparative Examples 5, 7, 8, 10, 11, 13, 14, 16, 17, 19, 20 and 21 have less than 500 precipitates/μm², the precipitate having an average particle size of 10 nm to 100 nm, they are poor in strength and heat resistance. Also, it was found that the initial contact resistance is high and the terminal characteristics are not satisfied.

Regarding the terminals of Comparative Examples 5, 7, 8, 10, 13, 16 and 19, since there is no aging step or the heat treatment in the aging step was insufficient due to a low temperature or a short period of time, a sufficient precipitate density was not obtained and a sufficient initial resistance was not obtained due to an insufficient material strength. Furthermore, since these are alloys having a poor stress relaxation resistance, it is assumed that the resistance after heat treatment test will not be sufficient characteristics. Regarding the terminals of Comparative Examples 6, 9, 12, 15 and 18, since they have an oxide layer of tin oxide having a thickness of greater than 50 nm, the initial contact resistance is high and the terminal characteristic was not satisfied.

It was found that, in Comparative Example 22, since it does not include a metal coating forming process, a metal coating layer was not formed on the base material, and an electric conductivity was not obtained at the contact, the initial contact resistance is high and the terminal characteristics are not satisfied.

Also, as shown in Table 5, in Comparative Examples 23 to 30, a portion subjected to working broke in the first terminal working step or in the second terminal working step, and when it was formed into a terminal shape, a crack was produced in the base material. That is, a defect was produced during the manufacture of a terminal. Therefore, as a terminal, it was not possible to perform evaluation. Such a terminal lacks reliability, and thus cannot be used as a terminal. Based on the above, it can be seen that a good terminal made of aluminum cannot be formed under conditions E, F, I and J.

Further, one of the films shown as Film Nos. 1 to 6 in Table 6 was formed on the base material of Alloy Composition No. 1, and the evaluation result of a terminal manufactured with each manufacturing conditions (A1 and B to D) in Table 7 were indicated as Examples 6 to 11 and Comparative Examples 31 to 42.

TABLE 6

| Coating No. | Outermost Layer Metal |
|---|---|
| 1 | Sn |
| 2 | Cr |
| 3 | Cu |
| 4 | Zn |
| 5 | Ag |
| 6 | Au |

From the results shown in Table 7, it was found, since that the terminals of Examples 6 to 10 have a base material having a composition comprising 2.15 mass % in total of at least one element selected from Mg, Si, Cu, Cr and Zr, the balance being Al and incidental impurities, and has 3500 precipitates/$\mu m^2$, the precipitate having an average particle size of 10 nm to 100 nm, and further the metal coating layer composed primarily of one of oxides of Sn, Cr, Cu, Zn, Au and Ag has a thickness of less than or equal to 50 nm, and the yield strength is greater than or equal to 230 MPa, and the stress relaxation ratio of less than 50%, the terminals of Examples 6 to 10 has an improved terminal formability and workability, and are low in their initial contact resistance, contact resistance after corrosion test and contact resistance after heat treatment test.

Also, it was found that, since the terminal of Example 11 has a base material having a composition comprising 2.15 mass % in total of at least one element selected from Mg, Si, Cu and Cr, the balance being Al and incidental impurities, and has 3500 precipitates/$\mu m^2$, the precipitate having an average particle size of 10 nm to 100 nm, and the metal coating layer composed of Au, and an Au oxide layer was not formed under manufacturing condition Al, the terminal of Example 11 has an improved terminal formability and workability, and are low in its initial contact resistance, contact resistance after corrosion test and contact resistance after heat treatment test.

In Comparative Examples 31, 33, 34, 36, 37, 39, 40 and 42, since there is no aging step or the heat treatment was insufficient due to a low temperature or a short period of time, a sufficient precipitate density was not obtained and a sufficient initial resistance was not obtained due to an

TABLE 7

| | Alloy No. | Coating No | Condition | Precipitation (number of particles/$\mu m^2$) | Thickness of Oxide Layer (nm) | Yield Strength | Stress Relaxation Ratio | Contact Resistance Initial | Contact Resistance After Corrosion Test | Contact Resistance After Heat Treatment Test |
|---|---|---|---|---|---|---|---|---|---|---|
| EXAMPLE 6 | 1 | 1 | A1 | 3500 | 15 | ○ | ○ | ○ | ○ | ○ |
| EXAMPLE 7 | 1 | 2 | A1 | 3500 | 15 | ○ | ○ | ○ | ○ | ○ |
| EXAMPLE 8 | 1 | 3 | A1 | 3500 | 15 | ○ | ○ | ○ | ○ | ○ |
| EXAMPLE 9 | 1 | 4 | A1 | 3500 | 15 | ○ | ○ | ○ | ○ | ○ |
| EXAMPLE 10 | 1 | 5 | A1 | 3500 | <5 | ○ | ○ | ○ | ○ | ○ |
| EXAMPLE 11 | 1 | 6 | A1 | 3500 | — | ○ | ○ | ○ | ○ | ○ |
| COMPARATIVE EXAMPLE 32 | 1 | 1 | B | ***300*** | 5 | X | X | X | — | — |
| COMPARATIVE EXAMPLE 32 | 1 | 1 | C | 2000 | ***70*** | ○ | ○ | X | — | — |
| COMPARATIVE EXAMPLE 33 | 1 | 1 | D | ***60*** | <5 | X | X | X | — | — |
| COMPARATIVE EXAMPLE 34 | 1 | 2 | B | ***400*** | <5 | X | X | X | — | — |
| COMPARATIVE EXAMPLE 35 | 1 | 2 | C | 2200 | ***60*** | ○ | ○ | X | — | — |
| COMPARATIVE EXAMPLE 36 | 1 | 2 | D | ***20*** | <5 | X | X | X | — | — |
| COMPARATIVE EXAMPLE 37 | 1 | 3 | B | ***300*** | <5 | X | X | X | — | — |
| COMPARATIVE EXAMPLE 38 | 1 | 3 | C | 1800 | ***80*** | ○ | ○ | X | — | — |
| COMPARATIVE EXAMPLE 39 | 1 | 3 | D | ***40*** | <5 | X | X | X | — | — |
| COMPARATIVE EXAMPLE 40 | 1 | 4 | B | ***400*** | <5 | X | X | X | — | — |
| COMPARATIVE EXAMPLE 41 | 1 | 4 | C | 2000 | ***60*** | ○ | ○ | X | — | — |
| COMPARATIVE EXAMPLE 42 | 1 | 4 | D | ***25*** | <5 | X | X | X | — | — |

N.B. NUMERICAL VALUES IN BOLD ITALIC IN THE TABLE ARE OUT OF APPROPRIATE RANGE OF EXAMPLE insufficient material strength. Furthermore, since these are alloys having a poor stress relaxation resistance, it is assumed that the resistance after heat treatment test will not be sufficient characteristics.

In each of Comparative Examples 32, 35, 38 and 41, it was found that, since the thickness of the oxide layer composed of a tin oxide exceeds 50 nm, the initial contact resistance was high, and the terminal characteristic was not satisfied.

Based on the forgoing, it was found that, since the terminal of the present embodiment is a terminal including a base material, a metal coating layer and an oxide layer, and the base material has a composition comprising 0.005 mass % to 3.000 mass % in total of at least one element selected from Mg, Si, Cu, Zn, Mn, Ni, Cr and Zr, the balance being Al and incidental impurities, and has greater than or equal to 500 precipitates/$\mu m^2$, the precipitate having an average particle size of 10 nm to 100 nm, and the metal coating layer is composed of Sn, Cr, Cu, Zn, Au or Ag or an alloy composed primarily thereof, and in a case where the oxide layer exists, the oxide layer is composed primarily of an oxide of Sn, Cr, Cu, Zn or Ag, and has a thickness of less than or equal to 50 nm, the terminal has an improved strength, heat resistance as well as formability and workability, and showed a low contact resistance initially and after an endurance test.

The terminal of the present disclosure is applicable to terminals of automobiles in which an aluminum harness is installed.

What is claimed is:

1. A method of manufacturing a terminal, comprising, in the following order:

preparing a sheet material comprising greater than or equal to 0.005 mass % and less than or equal to 3.000 mass % in total of at least one element selected from Mg, Si, Cu, Zn, Mn, Ni, Cr and Zr, the balance being Al and incidental impurities;

performing solution heat treatment by heating the sheet material;

cold rolling the solution heat treated sheet material;

forming a metal coating layer over a part of or an entirety of the cold-rolled sheet material, the metal coating layer being composed primarily of Sn, Cr, Cu, Zn, Au or Ag, or an alloy composed primarily thereof;

forming a developed terminal material by punching the sheet material on which the metal coating layer is formed into a developed view geometry of a terminal;

forming the developed terminal material into a terminal; and performing an aging treatment on the terminal under a condition of 150° C. to 190° C. for 60 to 600 minutes.

2. The method of manufacturing a terminal according to claim 1, further comprising forming an undercoat layer between the sheet material and the metal coating layer.

3. A method of manufacturing a terminal, comprising, in the following order:

preparing a sheet material comprising greater than or equal to 0.005 mass % and less than or equal to 3.000 mass % in total of at least one element selected from Mg, Si, Cu, Zn, Mn, Ni, Cr and Zr, the balance being Al and incidental impurities;

performing solution heat treatment by heating the sheet material;

cold rolling the solution heat treated sheet material;

forming a developed terminal material by punching the cold-rolled sheet material into a developed view geometry of a terminal;

forming a metal coating layer over a part of or an entirety of the developed terminal material, the metal coating layer being composed of Sn, Cr, Cu, Zn, Au or Ag or an alloy composed primarily thereof;

forming the developed terminal on which the metal coating layer is formed into a terminal; and performing an aging treatment on the terminal under a condition of 150° C. to 190° C. for 60 to 600 minutes.

4. The method of manufacturing a terminal according to claim 3, further comprising forming an undercoat layer between the sheet material and the metal coating layer.

* * * * *